US009318819B2

(12) United States Patent
Bäckström et al.

(10) Patent No.: US 9,318,819 B2
(45) Date of Patent: Apr. 19, 2016

(54) CABLE TERMINAL HAVING A PROJECTION FORMING A ROOF TO PREVENT A SCREW HEAD FROM BEING DISMANTLED

(71) Applicant: Scania CV AB, Södertälje (SE)

(72) Inventors: Johan Bäckström, Vaxholm (SE); Raoul Ilia, Södertälje (SE)

(73) Assignee: SCANIA CV AB (SE)

( * ) Notice: Subject to any disclaimer, the term of this patent is extended or adjusted under 35 U.S.C. 154(b) by 0 days.

(21) Appl. No.: 14/195,134

(22) Filed: Mar. 3, 2014

(65) Prior Publication Data

US 2014/0246233 A1 Sep. 4, 2014

(30) Foreign Application Priority Data

Mar. 4, 2013 (SE) ..... 1350257

(51) Int. Cl.

| | |
|---|---|
| ***H01R 4/36*** | (2006.01) |
| ***H01R 4/56*** | (2006.01) |
| ***H01R 4/30*** | (2006.01) |
| ***H01R 4/34*** | (2006.01) |
| ***H01R 11/12*** | (2006.01) |

(52) U.S. Cl.

CPC ..... *H01R 4/56* (2013.01); *H01R 4/301* (2013.01); *H01R 4/305* (2013.01); *H01R 4/34* (2013.01); *H01R 11/12* (2013.01)

(58) Field of Classification Search

CPC ..... H01R 4/30; H01R 4/301; H01R 4/302

USPC ..... 439/801–813

See application file for complete search history.

(56) References Cited

U.S. PATENT DOCUMENTS

| | | | | | |
|---|---|---|---|---|---|
| 2,497,523 | A | | 2/1950 | Warkentin | |
| 3,258,733 | A | * | 6/1966 | Bollinger | 439/400 |
| 3,279,518 | A | * | 10/1966 | Bollinger | 411/166 |
| 4,040,715 | A | * | 8/1977 | Debaigt | 439/813 |
| 4,488,770 | A | | 12/1984 | Lui | |

(Continued)

FOREIGN PATENT DOCUMENTS

EP 2 302 750 5/2011

OTHER PUBLICATIONS

European Search Report dated May 30, 2014.

*Primary Examiner* — Chandrika Prasad

(74) *Attorney, Agent, or Firm* — Ostrolenk Faber LLP

(57) ABSTRACT

A cable terminal for electrical connection of a wire to a component. The cable terminal (3) includes a first part (6) and a second part (7). A first part (6) connects to the wire. A second part (7) includes a longitudinal and continuous slot (19) with a first section (8), adapted to the width of a screw head on a screw with which the cable terminal is to be fitted to the component, and a second section (10), adapted to the width of the screw's threaded section. In a first position the slot (19) can be passed over the screw head in the first section (8) so that the cable terminal (3) can be displaced in a direction along the slot so that the screw ends up in a second position in the second section (10). The second part (7) of the cable terminal includes a part (12) that forms a roof (13) positioned at least partly above the first section (8).

12 Claims, 3 Drawing Sheets

(56) References Cited

U.S. PATENT DOCUMENTS 5,771,983 A * 6/1998 Rottmann ..... 174/84 C
6,053,780 A * 4/2000 Ono et al. ..... 439/810
6,126,493 A 10/2000 Price
7,611,360 B2 * 11/2009 Akahori et al. ..... 439/76.2
7,914,300 B2 * 3/2011 Akahori et al. ..... 439/76.2

* cited by examiner

CABLE TERMINAL HAVING A PROJECTION FORMING A ROOF TO PREVENT A SCREW HEAD FROM BEING DISMANTLED

CROSS-REFERENCE TO RELATED APPLICATIONS

The present application claims priority of Swedish Application No. 1350257-0, filed Mar. 4, 2013, the contents of which are incorporated by reference herein.

SCOPE OF THE INVENTION

The invention refers to a cable terminal installation guide to prevent incorrect installation of the terminal on an electrical component.

BACKGROUND OF THE INVENTION

A cable terminal is a form of connector for electric cables. A cable terminal can also be referred to as a cable lug, cable clip, cable eye or cable shoe. The cable terminal is usually designed so as to be able to be attached firmly to a cable or wire at one end of the cable terminal so that the other end can be screwed firmly into some contact point on an electrical component.

The cable terminal must meet statutory norms and standards, as well as coping with a high current load. The customary material for a cable terminal is a material with good conductive properties such as copper, brass, bronze, new silver (alpacca) or steel. The cable terminal is often fitted to a component manually, in which case demanding requirements are made of the terminal's ability to be fitted quickly, simply and correctly. Furthermore, the cable terminal is a link connecting a wire and a component, and must be able to cope with stresses such as being tugged without breaking. To this end, for example, cable housings have been developed which do not come off when the cable is pulled.

A cable terminal, then, is used when an electrical contact is needed between a wire and an electrical component. An example of such an application is a fuel injector for a cylinder in a combustion engine. The injector needs to be energized in order to be able to correctly control the injection of fuel into the combustion chamber. It is extremely important, therefore, that the cable terminal is correctly mounted in order to be able to power the injector. Since a cable terminal linking the injector with an electrical wire is often fitted in a factory environment under pressure of time, it is important to be able to guarantee correct fitting of the cable terminal in a quick and simple fashion. Faults that can occur when the cable terminal is incorrectly fitted are short-circuiting, tearing, the wire and/or cable terminal getting in the way of other parts, the cable terminal snapping off and so on. One way of ensuring that the cable terminal is fitted in a particular direction, for example, is to make use of lugs matching slots in the cable terminal. However, there is no good way of ensuring that the cable terminal is not fitted upside-down. One customary and simple cable terminal design is to shape it from a piece of punched metal, one end being designed with a slot in order to fit to a screw on a component and the other end being designed as upturned tabs which are depressed to enclose and secure a wire. In such a design the wire is fixed to one face of the cable terminal while the opposite face is essentially flat in order to be able to make tight contact with the component and attach to it with a screw joint. In the event of the cable terminal being fitted with the wrong face facing the component, the retaining screw will press not merely against the intended part of the cable terminal but also against the part where the wire is connected, also pressing against the actual wire in this way. This not only impairs the contact face but produces a risk of the screw joint being tightened to the wrong torque with the resultant risk of working loose after a while. When fitted under pressure of time, the cable terminal can easily end up being fitted with the wrong side facing the component. The same risk exists when accessibility and visibility are restricted during fitting.

The aim of the invention is thus to provide a cable terminal which facilitates correct fitting of the same to a component. One aim of the invention is to ensure that, when fitting, the correct side of the cable terminal faces the intended contact face on the component.

SUMMARY OF THE INVENTION

The above purpose is achieved by a cable terminal disclosed herein. The cable terminal thus includes a part provided with a projecting part forming a roof positioned at least partly above the first section of the slot at a distance at least equivalent to the height of the screw head when the slot has been passed over the screw head in the initial position. By virtue of having a roof over the first part of the slot, the cable terminal can just be slipped over the screw head through the first part of the slot from the side of the cable terminal which does not incorporate the top, in this way preventing the cable terminal from being fitted upside-down. Problems such as short-circuiting, incorrect wear and splitting can be eliminated.

The invention is applicable to various applications involving a cable terminal as the connecting component between a cable and a connection to a component. The invention saves time and money in the production run since it eliminates the need to take applications out of production owing to the cable terminal proving to be on upside-down when tested.

In an application for a combustion engine exemplified above, incorrect fitting can be detected by the engine running poorly and giving out malfunction signals. The invention eliminates the occurrence of such problems.

Additional distinctive features and benefits distinguishing the invention are set out in the following detailed descriptions of exemplificatory advantageous embodiments.

BRIEF DESCRIPTION OF THE DRAWINGS

Below, the invention will be described with reference to the attached Figures, of which.

DETAILED DESCRIPTION OF PREFERRED EMBODIMENTS OF THE INVENTION

Descriptions consistently use the same reference terms for the same and similar parts.

Figure 1A:
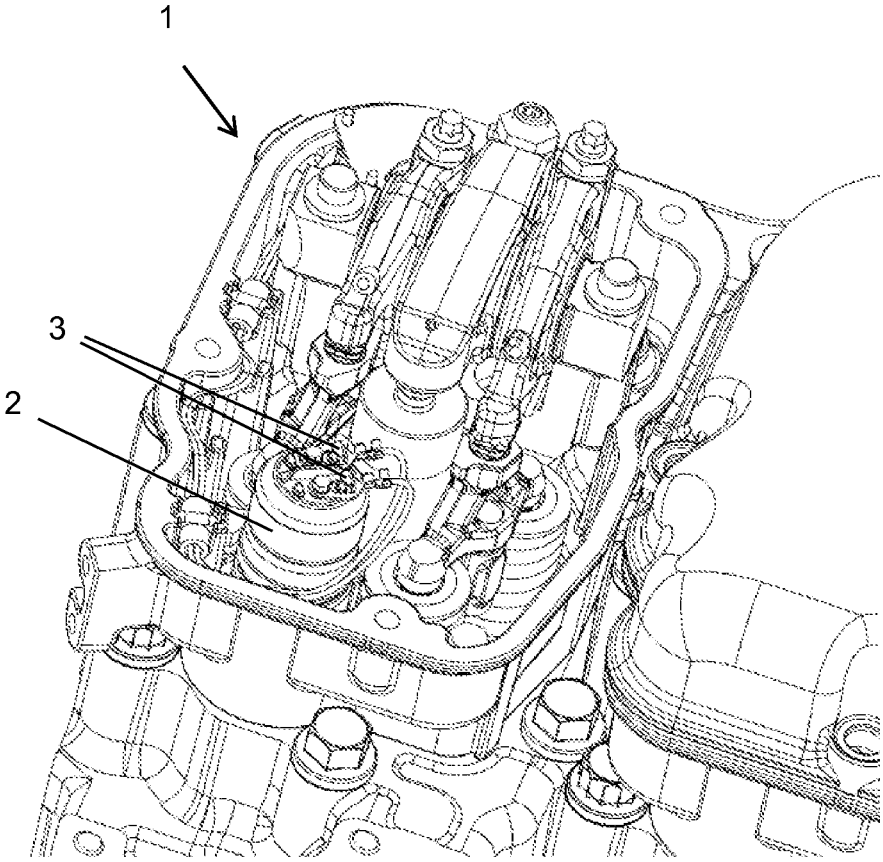
FIG. 1A shows an engine in which two cable terminals are seen mounted on an injector.
Figure 1B:
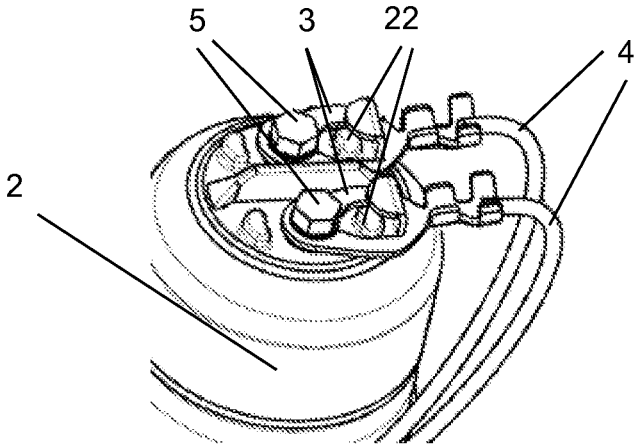
FIG. 1B shows a detailed view of the top of the injector shown in FIG. 1A.

FIGS. 1A and 1B illustrate how two cable terminals 3 can be used in an application, as exemplified here by a combustion engine 1. The cable terminal 3, which will be described here, can be used for many other different applications requiring a connector between an electrical wire and an electrical component.

FIG. 1A shows a cylinder head for a cylinder in a combustion engine 1, for example a diesel engine in a vehicle. In this application two cable terminals 3 are fitted to the top of an electrical component in the form of a fuel injector 2. FIG. 1B shows a magnified view of the top of the injector 2 shown in FIG. 1A. Two wires 4 are interconnected to each cable terminal 3, which is then connected to each screw 5 on the top of the injector 2. The screws 5 secure the cable terminals 3 to the injector top when the screws 5 are screwed tightly into threaded holes in the top of the injector. Here the top of the injector is also provided with lugs 22 which fit into slots 19 in the cable terminals 3. The slot 19 can thus be modified to match one or more corresponding lugs 22. The lugs 22 are used to guide the cable terminals 3 in a certain direction in order to successfully mount the cable terminals 3 in a particular direction.

FIGS. 2A-2D show the cable terminal 3 from various angles. As can be seen from the figures, the cable terminal 3 includes a first part 6 and a second part 7. The first part 6 is adapted to receive and be in electrical contact with a wire 4. The first part 6, for example, can have an elongated design in the form of an elongated bottom and can feature holders, here a rear 17 and a front 18 holder, in the form of projecting parts 17, 18 extending upwards on either side around the elongated bottom in order to be able to clasp the wire 4. Since the wire 4 has been positioned in the first part 6 along the elongated bottom, the holders 17, 18 can then be clamped on and in this way secured to the wire 4. Other embodiments of the first part 6 are conceivable, however; for example, the first part 6 can be provided with a tube into which the wire 4 can be inserted. When the wire 4 is placed in the tube, the tube can be clamped on and the wire 4 thus secured tightly to the cable terminal 3.

The second part 7 of the cable terminal 3 includes a longitudinal, continuous slot 19. The slot 19 presents a first section 8 with a first width 9 adapted to the width of a screw head 20 (FIG. 3A) on a screw 5 with which the cable terminal 3 is to be mounted. 'Adapted' here refers to the width 9 being sufficiently great for the screw head 20 to be able to pass freely through the first section 8 on the slot 19. The slot 19 further presents a second section 10 with a different width 11 adapted to the width of the body 21 (FIG. 3A) of the screw 5. The second width 11 is thus smaller than the first width 9 and not sufficiently large to allow the passage of the screw head 20. The body of the screw 21 is at least partly designed with threads, making it possible to screw the screw firmly to a component 2.

When mounted on a pre-fitted screw on the component 2, the slot 19 can then be passed in a first position over the screw head 20 in the first section 8. The cable terminal 3 can then be displaced in a direction along the slot 19 so that the screw 5 ends in a second position in the second section 10, in which second position the cable terminal 3 is prevented from coming off the screw 5 vertically (in an axial direction). The second part 7 can have an elongated design, as shown in the figure. The slot 19, for example, can be bottle or keyhole shaped, as shown in the figure. Alternatively, the first section 8 can have a mainly circular design, or a shape adapted entirely to that of the screw head 20, for example a hexagonal shape. The second part 8 of the cable terminal 3 is also provided with a projecting part 12 forming a roof 13 positioned at least partly above the first section 8 on the slot 19 at a distance 28 corresponding to at least the height of the screw head 20 when the slot 19 has been passed over the screw head 20 in the first position.

The projecting part 12 shown in the figures can take the shape of an 'L'.In alternative embodiments the projecting part 12 can have a more curved design. In alternative embodiments the projecting part 12 can include a number of smaller projecting parts which combine to form the projecting part 12. As shown in the figures, the projecting part 12 can be located as an extension of the first section 8 on the slot 19. The projecting part 12 can be positioned along the first section 8 on the slot 19, for example along one side of the first section 8 on the slot 19 that does not constitute a side of the second section 10. In the figures the projecting part 12 is positioned along the first section 8 on the slot 19 opposite the side of the first section 8 on the slot 19, which also makes up a side of the second section 10. Alternatively, the projecting part 12 can be positioned at a distance from the cable terminal 3, for example on an upper face 29 of the second part of the cable terminal 3 or on some edge of the cable terminal 3.

Figure 2A:
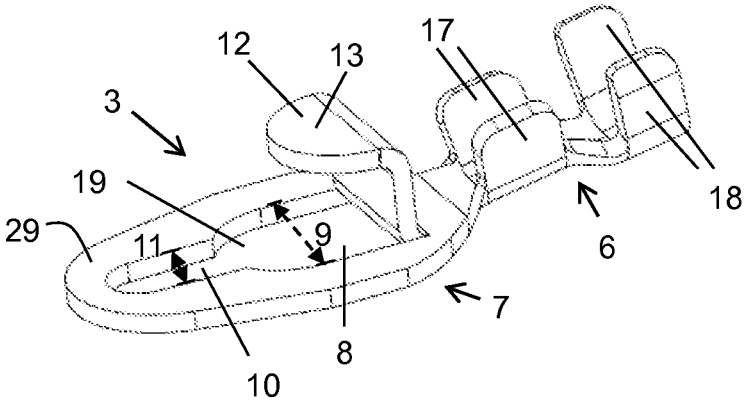
FIG. 2A shows a cable terminal according to one embodiment of the invention.
Figure 2B:
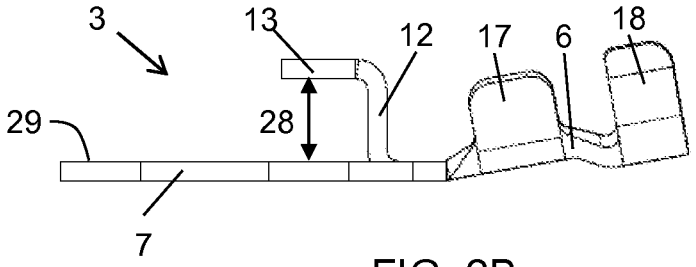
FIG. 2B shows the cable terminal in FIG. 2A seen from the side.

FIG. 2B shows the cable terminal 3 from a side angle. The cable terminal's 3 second part 7 extends horizontally here, with the first part 6 extending upwards at something of an angle, starting from the second part 7. The projecting part 12 has the shape of an 'L' here and protrudes vertically from the cable terminal's 3 second part 7. The roof 13 is positioned parallel to the second part's 7 extension at a distance 28 across the cable terminal's 3 upper face 29. The distance 28 is at least the same size as the height 26 of the screw head 20 (FIG. 3A) so as to make room for the screw head 20 between the roof 13 and the upper face 29 on the second part 7.

Figure 2C:
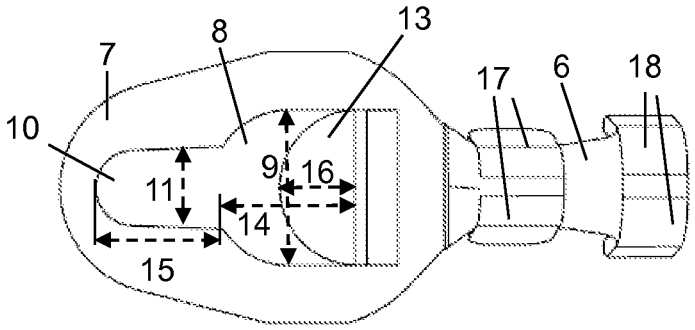
FIG. 2C shows the cable terminal in FIG. 2A seen from below.
Figure 2D:
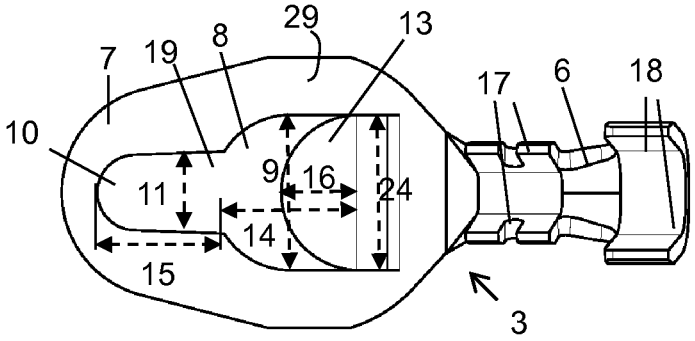
FIG. 2D shows the cable terminal in FIG. 2A seen from above.

FIG. 2C shows the cable terminal 3 viewed from below and FIG. 2D shows the cable terminal 3 from above. The roof 13 on the projecting part 12 can in FIG. 2D be seen positioned partly above the first section 8. The roof 13 has a length 16 and a width 24. As previously explained, the first section 8 has a width 9, but also a length 14. The width 9 and the length 14 are adapted to the width of the screw head 20, and hence its diameter. The width 9 and the length 14 of the first section 8 are each at least equal to or greater than the width 25 of the screw head 20. The roof 13 of the projecting part 12 covers enough of the first section 8 to prevent the cable terminal 3 from being mounted upside down. According to one embodiment the roof 13 of the projecting part 12 covers at least half of the first section 8 on the slot 19. In accordance with an additional embodiment the roof 13 of the projecting part 12 covers primarily the whole of the first section 8 on the slot 19. The length 16 of the roof 13 can be, for example, 50-100% of the length 14 of the first section 8. As previously explained, the function of the projecting part 12 of the roof 13 merely serves to enable the cable terminal 3 to be fitted the right way up. The roof 13 blocks the first section 8, preventing the cable terminal 3 from being mounted upside-down over the screw head 20 through the first section 8. The design of the projecting part 12 must thus be such as to block the introduction of the screw head 20 in the first section 8 from that side of the cable terminal 3 which presents the upper face 29 and on which side the projecting part 12 protrudes. The projecting part 12 must preferably also prevent the screw 5 from being tightened with a tool before the screw 5 has been placed in the second section 10. In this way the cable terminal 3 can be prevented from breaking if positioned incorrectly.

As illustrated in the figures and particularly in FIG. 2C and FIG. 2D, the second width 11 of the second section 10 is smaller than the first width 9 of the first section 8. The second width 11 here is smaller than the width of the screw head 20 but greater than the width 27 of the body 21 of the screw (FIG.

Figure 3A:
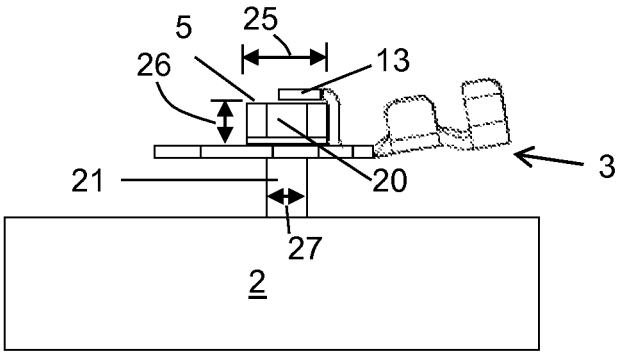
FIG. 3A-3D shows the cable terminal in various positions when screw-mounted to a component.
Figure 3B:
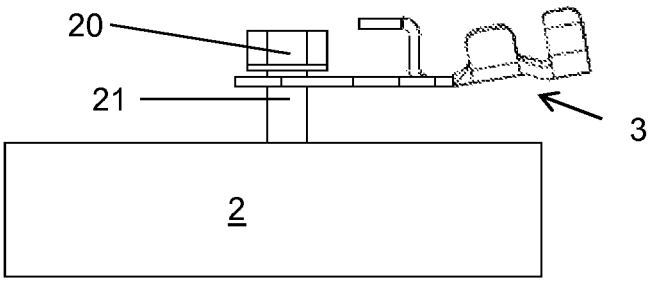

3A). In this way the screw 5 with its screw head 20 can be inserted into and through the first section 9, then guided laterally with its body 21 into the second section 10. Since the width 25 of the screw head 20 is greater than the second width 11 of the second section 10, the cable terminal 3 cannot fall off the screw 5 in the vertical direction of the screw 5. The height 26 of the screw head 20 is illustrated in FIG. 3A. The second section 10 also has a length 15. The length 15 must be at least as great as or greater than the width 27 of the screw body 21, i.e. the diameter of the screw body 21. What is meant by the screw body 21 here is both the threaded part of the screw 5 and any unthreaded part of its axial rod. The length 15 of the second section 10 is according to one embodiment at least as great as half the width 25 of the screw head 20. According to another embodiment the length 15 of the second section 10 is at least as great as half the width 25 of the screw head 20 plus half the width 27 of the screw body 21. Thereby it is ensured that all of the screw head 20 fits outside the roof 13.

The cable terminal 3 can be variously manufactured: for example, the whole of the cable terminal 3 can be manufactured in one piece by bending and punching a plate-shaped material from which the cable terminal 3 is to be made. The projecting 12 part can be punched or cut out, then bent into the desired shape. According to one embodiment, at least some of the first 6 and second part 7 of the cable terminal 3, and the projecting part 12, is made in one piece. For example, the first 6 and second part 7 can be manufactured in one piece and the projecting part 12 welded on in due course. The cable terminal 3, for example, can be made from brass, bronze, new silver or steel. The cable terminal 3, however, can be made from some other material with good electrical conductivity, for example copper, which is then plated.

Figure 3C:
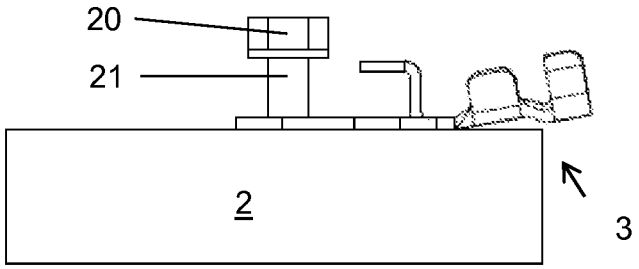
Figure 3D:
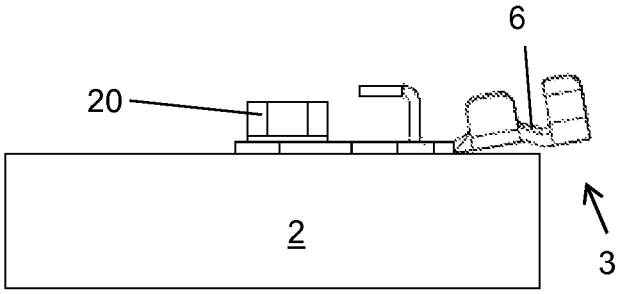

FIGS. 3A-3D show how the cable terminal 3 is fitted to an arbitrary component 2 via the screw 5. The projecting part 12 and the roof 13 are arranged on the side of the cable terminal 3 facing away from the component 2 to which it is intended to be fitted. The roof in this application is also arranged on the same side of the cable terminal as the angled-up parts 17, 18. As previously explained, the component can be an injector, for instance. The figures show a cable terminal 3 without any wire connected 4, though a wire 4 will usually be connected to the cable terminal 3 before fitting the cable terminal 3 to a connection face on the component 2. The screw 5 is initially screwed firmly into a threaded hole in the component 2, or is pre-fitted in the threaded hole. The cable terminal 3 is then passed over the screw head 20 through the first section 8 to the first position, as shown in FIG. 3A. The screw head 20 has been passed entirely through the first section 8 and is precluded by the roof 13 from being guided further upwards. Now the cable terminal 3 is displaced horizontally along the slot 19 so as to position the screw 5 in the second section 10 and until the cable terminal 3 comes to a second position shown in FIG. 3B. In this position the cable terminal 3 can no longer be dismantled from the screw 5 in the vertical direction of the screw 5 since the width 11 of the second section 10 is smaller than the width 25 of the screw head 20. The second position, for example, can present itself when the screw body 21 is in some end position of the second section 10. The cable terminal 3 is then guided vertically downwards and positioned close in to the component 2, which is shown in FIG. 3C, and the screw 5 finally tightened with a tool that tightens the screw 5 with suitable torque. The cable terminal 3 is now correctly fitted to the component 2, which is illustrated in FIG. 3D. As seen in FIG. 3D, the cable terminal 3 is now fitted so that the first part 6 on the cable terminal 3 is angled up from the component 2. The alignment between the bottom of the cable terminal 3 and the top of the component 2 allows a large, flat contact face and correspondingly good electrical contact between these. It is easy to see that if the cable terminal 3 had not been designed with the projecting part 12 and the roof 13, the cable terminal 3 might have been wrongly fitted upside-down. In the process the cable terminal's angled-up parts 17, 18 would prevent such a flat fit between the cable terminal 3 and the component 30. This would not only have resulted in impaired electrical contact but would also have risked the screw causing damage or being insufficiently tightened.

The present invention is not restricted to the embodiments described above. In an alternative embodiment, for example, the narrow part 10 of the slot 19 can face the part of the cable terminal where the wire is intended to be connected. In such an embodiment the roof 13 of the projecting part can be aligned with the wire, and hence in the opposite direction to that described above. In one additional alternative embodiment the direction of the slot can be pointed in a transverse instead of a longitudinal direction as described. The direction of the roof 13 can be aligned in an arbitrary direction; the only requirement is that it at least partly covers the cable terminal's slot 19 in the part which is guided over the head of a pre-fitted screw when mounted.

The invention claimed is:

1. A cable terminal including a first part and a second part:

the first part is configured to receive and be in electrical contact with a wire;

the second part includes a longitudinal and continuous slot therein, the slot includes a first section with a first width across the longitudinal slot and the first section, and the first width is selected to be related to a horizontal width of a screw head on a screw with which the cable terminal is to be mounted; the slot further includes a second section with a second width across the longitudinal slot and the first section, and the second width is selected to be related to a horizontal width of a body of the screw such that in a first position of the cable terminal relative to the screw, the slot can be slipped over the screw head in the first section of the slot, whereafter the cable terminal can be displaced in a direction along the longitudinal slot so that the screw ends up in a second position in the second section of the slot, and in the second position, the cable terminal is prevented by the screw head from being dismantled from the screw in a vertical direction of the screw;

a projecting part of the second part of the cable terminal is configured to form a roof positioned above at least part of the first section of the slot, the roof is arranged on one side of the cable terminal, the roof having a flat horizontal surface parallel to a horizontal plane of the second part, and the roof being located and configured to allow the cable terminal then in the first position to be slipped over the screw head in the first section from one direction only.

2. The cable terminal in accordance with claim 1, wherein the projecting part roof is spaced out above the second part at a distance corresponding to at least a height of the screw head when the slot has been slipped over the screw head in the first position.

3. The cable terminal in accordance with claim 1, wherein the projecting part has the shape of an 'L' including a leg up from the second part as one leg of the 'L' and the roof as another leg of the 'L'.

4. The cable terminal according to claim 1, wherein the projecting part is positioned as an extension over the first section of the slot.

5. The cable terminal according to claim 1, wherein the projecting part has a width in a direction across the slot that is approximately as big as the first width of the first section of the slot.

6. The cable terminal according to claim 1, wherein the roof of the projecting part is located and shaped to cover at least half of the first section of the slot longitudinally.

7. The cable terminal according to claim 1, wherein the slot is configured to match one or more corresponding lugs on a body to which the terminal is to be mounted for orienting the terminal with reference to the body.

8. The cable terminal according to claim 1, wherein the second width of the second section is smaller than the first width of the first section.

9. The cable terminal according to claim 1, wherein at least some of the first and the second parts of the cable terminal and the projecting part is made in one piece.

10. A connection of an electrical wire to an electrical component including:

a cable terminal according to claim 1;

a device on which the second part of the cable terminal is to be mounted;

the screw is provided with the screw head above the device on which the terminal is mounted; and a wire connected to the cable terminal.

11. The connection of claim 10, wherein the screw has a body below the head thereof for mounting the device.

12. The cable terminal of claim 1, wherein the second section is positioned further away from the first part than the first section in a longitudinal direction.

* * * * *